US011634784B2

(12) United States Patent
Lee et al.

(10) Patent No.: US 11,634,784 B2
(45) Date of Patent: Apr. 25, 2023

(54) ULTRA-THICK STEEL MATERIAL HAVING EXCELLENT SURFACE PART NRL-DWT PROPERTIES AND METHOD FOR MANUFACTURING SAME

(71) Applicant: POSCO, Pohang-si (KR)

(72) Inventors: Hak-Cheol Lee, Pohang-si (KR); Sung-Ho Jang, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 318 days.

(21) Appl. No.: 16/469,480

(22) PCT Filed: Dec. 20, 2017

(86) PCT No.: PCT/KR2017/015141
§ 371 (c)(1),
(2) Date: Jun. 13, 2019

(87) PCT Pub. No.: WO2018/117650
PCT Pub. Date: Jun. 28, 2018

(65) Prior Publication Data

US 2020/0109461 A1 Apr. 9, 2020

(30) Foreign Application Priority Data

Dec. 22, 2016 (KR) ..... 10-2016-0176552

(51) Int. Cl.

| | |
|---|---|
| ***C22C 38/04*** | (2006.01) |
| ***C21D 9/46*** | (2006.01) |
| ***C21D 6/00*** | (2006.01) |
| ***C21D 8/02*** | (2006.01) |
| ***C22C 38/00*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |

(52) U.S. Cl.
CPC ..... *C21D 9/46* (2013.01); *C21D 6/001* (2013.01); *C21D 6/005* (2013.01); *C21D 8/0205* (2013.01); *C21D 8/0226* (2013.01); *C21D 8/0263* (2013.01); *C22C 38/002* (2013.01); *C22C 38/04* (2013.01); *C22C 38/08* (2013.01); *C22C 38/12* (2013.01); *C22C 38/14* (2013.01); *C22C 38/16* (2013.01); *C21D 2211/002* (2013.01); *C21D 2211/005* (2013.01)

(58) Field of Classification Search
CPC ..... C21D 9/46; C21D 6/001; C21D 6/005; C21D 8/0205; C21D 8/0226; C21D 8/0263; C21D 2211/002; C21D 2211/005; C22C 38/002; C22C 38/04; C22C 38/08; C22C 38/12; C22C 38/14; C22C 38/16
See application file for complete search history.

(56) References Cited

U.S. PATENT DOCUMENTS

| | | | | |
|---|---|---|---|---|
| 2009/0071578 | A1* | 3/2009 | Nakamura | C21D 8/0226 148/602 |
| 2015/0059912 | A1* | 3/2015 | Shimamura | C22C 38/48 138/177 |
| 2017/0327922 | A1 | 11/2017 | Lee et al. | |
| 2017/0335424 | A1 | 11/2017 | Lee et al. | |
| 2019/0093204 | A1 | 3/2019 | Lee et al. | |

FOREIGN PATENT DOCUMENTS

| | | | | |
|---|---|---|---|---|
| EP | 3042976 | A1 | | 7/2016 |
| JP | H11-256228 | A | | 9/1999 |
| JP | 2004-277858 | A | | 10/2004 |
| JP | 2013-227670 | A | | 11/2013 |
| JP | 2015-183273 | A | | 10/2015 |
| KR | 20140098900 | A | * | 8/2014 |
| KR | 10-2015-0112489 | A | | 10/2015 |
| KR | 20150112489 | A | * | 10/2015 |
| KR | 10-1597789 | B1 | | 2/2016 |
| KR | 10-2016-0078849 | A | | 7/2016 |
| KR | 10-2016-0078927 | A | | 7/2016 |
| KR | 10-2016-0078928 | A | | 7/2016 |
| KR | 10-2016-0079163 | A | | 7/2016 |
| KR | 10-2016-0079165 | A | | 7/2016 |
| WO | 2015/030210 | A1 | | 3/2015 |
| WO | 2016/105062 | A1 | | 6/2016 |
| WO | 2016/105064 | A1 | | 6/2016 |

(Continued)

OTHER PUBLICATIONS

Hwang Sung Doo, KR-20140098900-A english translation, Aug. 2014 (Year: 2014).*
Extended European Search Report dated Aug. 16, 2019 issued in European Patent Application No. 17883360.4.
International Search Report dated Apr. 3, 2018 issued in International Patent Application No. PCT/KR2017/015141 (with English translation).
Chinese Office Action dated Jul. 13, 2020 issued in Chinese Patent Application No. 201780078841.6 (with English translation).

(Continued)

*Primary Examiner* — Nicholas A Wang
*Assistant Examiner* — Maxwell Xavier Duffy
(74) *Attorney, Agent, or Firm* — Morgan, Lewis & Bockius LLP

(57) ABSTRACT

Disclosed are a high-strength ultra-thick steel material and a method for manufacturing same. The high-strength ultra-thick steel material comprises in weight % 0.04-0.1% of C, 1.2-2.0% of Mn, 0.2-0.9% of Ni, 0.005-0.04% of Nb, 0.005-0.03% of Ti and 0.1-0.4% of Cu, 100 ppm or less of P and 40 ppm or less of S with a balance of Fe, and inevitable impurities, and comprises, in a subsurface area up to t/10 (t hereafter being referred to as the thickness of the steel material), polygonal ferrite of 50 area % or greater (including 100 area %) and bainite of 50 area % or less (including 0 area %) as microstructures.

6 Claims, No Drawings

(56) References Cited

FOREIGN PATENT DOCUMENTS

WO 2016/143345 A1 9/2016

OTHER PUBLICATIONS

Japanese Office Action dated Jul. 28, 2020 issued in Japanese Patent Application No. 2019-530718.

* cited by examiner

ULTRA-THICK STEEL MATERIAL HAVING EXCELLENT SURFACE PART NRL-DWT PROPERTIES AND METHOD FOR MANUFACTURING SAME

CROSS-REFERENCE OF RELATED APPLICATIONS

This application is the U.S. National Phase under 35 U.S.C. § 371 of International Patent Application No. PCT/KR2017/015141, filed on Dec. 20, 2017, which in turn claims the benefit of Korean Application No. 10-2016-0176552, filed on Dec. 22, 2016, the entire disclosures of which applications are incorporated by reference herein.

TECHNICAL FIELD

The present disclosure relates to an ultra-thick steel material having excellent surface portion NRL-DWT properties and a method for manufacturing the same.

BACKGROUND ART

In recent years, the development of high strength ultra-thick steel has been required in designing the structures of ships, and the like, domestically and overseas. That is because, when using high-strength ultra-thick steel to design structures, there may be an economic gain due to a reduced weight of the structure, and a thickness of the structure may also be reduced. Accordingly, processing and welding operations may easily be performed.

Generally, when an ultra-thick high strength steel material is manufactured, an overall structure may not be sufficiently transformed due to a decrease in an overall reduction ratio, and the structure may become coarse. Also, a difference in cooling speeds may occur between a surface portion and a central portion due to an increased thickness during a rapid cooling process for securing strength, and accordingly, a large amount of a coarse low temperature transformation phase such as bainite may be created in a surface portion, such that it may be difficult to secure toughness. Particularly, in the case of resistance to brittle crack propagation, which indicates stability of a structure, a guarantee is increasingly required when the steel material is applied to a main structure of a ship, and the like, but there have been difficulties in guaranteeing resistance to brittle crack propagation due to degradation of toughness in the case of an ultra-thick steel material.

Many classification societies and steel companies have conducted large-scale tensile tests in which actual resistance to brittle crack propagation can be accurately tested to guarantee resistance to brittle crack propagation. However, as high costs may be generated in conducting tests, it may be difficult to guarantee resistance to brittle crack propagation when the test is applied in mass-production. To address the disadvantage, research into a small size substitution test which may substitute for the large-scale tensile test have been conducted. As the most effective test, a surface portion naval research laboratory drop-weight test (NRL-DWT) based on the ASTM E208-06 standard has been increasingly used by many classification societies and steel companies.

The surface portion NRL-DWT test has been used on the basis of research results which indicate that, when a microstructure of a surface portion is controlled, propagation of cracks may be slowed during brittleness and crack propagation, such that resistance to brittle crack propagation may improve. Also, a variety of techniques such as applying a surface cooling process during finish-rolling for refinement of a grain size in a surface portion and adjusting a grain size by endowing bending stress during rolling have been designed by other researchers. However, the technique has a problem in which productivity may significantly degrade when the technique is applied in a general mass-production system.

Meanwhile, it has been known that, when large contents of elements such as Ni, and the like, which may be helpful for improving toughness, are added, surface portion NRL-DWT properties may be improved. However, since such elements are expensive, it may be difficult to apply the elements in terms of manufacturing costs.

DISCLOSURE

Technical Problem

An aspect of the present disclosure is to provide an ultra-thick steel material having excellent surface portion NRL-DWT properties and a method for manufacturing the same.

Technical Solution

According to an aspect of the present disclosure, an ultra-thick high strength steel material is provided, the ultra-thick high strength steel material comprising, by weight %, 0.04 to 0.1% of C, 1.2 to 2.0% of Mn, 0.2 to 0.9% of Ni, 0.005 to 0.04% of Nb, 0.005 to 0.03% of Ti, 0.1 to 0.4% of Cu, 100 ppm or less of P, 40 ppm or less of S, and a balance of Fe and inevitable impurities, and the ultra-thick high strength steel material comprises polygonal ferrite of 50 area % or higher, including 100 area %, and bainite of 50 area % or less, including 0 area %, as a microstructure in a region up to a t/10 position in a subsurface area, where t is a thickness of the steel material.

According to another aspect of the present disclosure, a method of manufacturing an ultra-thick high strength steel material is provided, the method includes reheating a slab comprising, by weight %, 0.04 to 0.1% of C, 1.2 to 2.0% of Mn, 0.2 to 0.9% of Ni, 0.005 to 0.04% of Nb, 0.005 to 0.03% of Ti, 0.1 to 0.4% of Cu, 100 ppm or less of P, 40 ppm or less of S, and a balance of Fe and inevitable impurities; obtaining a hot-rolled steel sheet by rough-rolling the reheated slab and finish-rolling the rough-rolled slab under conditions of a temperature less than Ar3° C. on a slab surface during a final pass rolling and a temperature of Ar3° C. or higher and Ar3+50° C. or lower at a t/4 position from the slab surface; and water-cooling the hot-rolled steel sheet after a temperature of a surface of the hot-rolled steel sheet reaches Ar3-50° C. of less.

Advantageous Effects

According to the present disclosure, an ultra-thick steel material for a structure may have an advantage of excellent surface portion NRL-DWT properties.

However, aspects of the present disclosure are not limited thereto. Additional aspects will be set forth in part in the description which follows, and will be apparent from the description to those of ordinary skill in the related art.

Best Mode for Invention

In the description below, an ultra-thick steel material having excellent surface portion NRL-DWT properties will be described in detail.

An alloy composition and preferable content ranges of an ultra-thick steel material of the present disclosure will be described in detail. A content of each element is based on a weight unless otherwise indicated.

C: 0.04 to 0.1%

C is the most important element in relation to securing basic strength in the present disclosure. Thus, it may be necessary to add C to steel within an appropriate range. To obtained such an effect in the present disclosure, a preferable content of C may be 0.04% or higher. When a content of C exceeds 1.0%, hardenability may improve such that a large amount of martensite-austenite constituent may be formed and the formation of a low temperature transformation phase may be facilitated, and accordingly, toughness may degrade. Thus, a preferable content of C may be 0.04 to 1.0%, and a more preferable content of C may be 0.04 to 0.09%.

Mn: 1.2 to 2.0%

Mn is an element which may improve strength by solid solution strengthening and may improve hardenability such that a low temperature transformation phase may be formed. Thus, it may be required to add 1.2% or higher of Mn to satisfy 390 MPa or higher of yield strength. However, when a content of Mn exceeds 2.0%, hardenability may excessively increase, which may facilitate the formation of upper bainite and martensite, and impact toughness and surface portion NRL-DWT properties may greatly degrade. Thus, a preferable content of Mn may be 1.2 to 2.0%, and a more preferable content of Mn may be 1.3 to 1.95%.

Ni: 0.2 to 0.9%

Ni is an important element in that Ni may improve impact toughness by facilitating cross slip of dislocation at a low temperature, and may improve strength by improving hardenability. To improve impact toughness and resistance to brittle crack propagation of high-strength steel having yield strength of 390 MPa or higher, a preferable content of Ni may be 0.2% or higher. When a content of Ni exceeds 0.9%, hardenability may excessively increase such that there may be a problem in which a low temperature transformation phase may be formed, toughness may degrade, and manufacturing costs may increase. Thus, a preferable content of Ni may be 0.2 to 0.9%, a more preferable content of Ni may be 0.3 to 0.8%, and an even more preferable content of Ni may be 0.3 to 0.7%.

Nb: 0.005 to 0.04%

Nb may improve strength of a base material by being precipitated in NbC or NbCN form. Nb solute during reheating at a high temperature may also have an effect that Nb may refine a structure by being precipitated in refined form in NbC form during rolling and preventing recrystallization of austenite. Thus, a preferable content of Nb may be 0.005% or higher. When a content of Nb exceeds 0.04%, brittleness cracks may be created on the corners of a steel material. Thus, a preferable content of Nb may be 0.005 to 0.04%, and a more preferable content of Nb may be 0.01 to 0.03%.

Ti: 0.005 to 0.03%

The addition of Ti may greatly improve low temperature toughness by being precipitated as TiN during reheating, and preventing growth of crystal grains of a base material and a welding heat affected zone. To effectively precipitate TiN, 0.005% or higher of Ti may need to be added. When a content of Ti exceeds 0.03%, which is excessive, low temperature toughness may decrease due to the blocking of a continuous casting nozzle and crystallization of a central portion. Thus, a content of Ti may be 0.005 to 0.03%, and a more preferable content of Ti may be 0.01 to 0.025%.

Cu: 0.1 to 0.4%

Cu is a main element which may improve strength of a steel material by improving hardenability and solid solution strengthening, and may also be a main element which may increase yield strength by forming an epsilon Cu precipitation when being tempered. Thus, a preferable content of Cu may be 0.1% or higher. When a content of Cu exceeds 0.4%, cracks may be created in a slab due to hot shortness during a steel making process. Thus, a preferable content of Cu may be 0.1 to 0.4%, and a more preferable content of Cu may be 0.1 to 0.3%.

P: 100 ppm or less, S: 40 ppm or less

P and S are elements which may cause brittleness in a grain boundary or may cause brittleness by forming a coarse inclusion. To improve resistance to brittle crack propagation, it may be preferable to control contents of P and S to be 100 ppm or less, and 40 ppm or less, respectively.

A remainder other than the above-described composition is Fe. However, in a general manufacturing process, inevitable impurities may be inevitably added from raw materials or a surrounding environment, and thus, impurities may not be excluded. A person skilled in the art may be aware of the impurities, and thus, the descriptions of the impurities may not be provided in the present disclosure.

In the description below, a microstructure of an ultra-thick high strength steel material will be described in detail.

An ultra-thick high strength steel material of the present disclosure may include polygonal ferrite of 50 area % or higher (including 100 area %) and bainite of 50 area % or less (including 0 area %), may more preferably include polygonal ferrite of 60 area % or higher (including 100 area %) and bainite of 40 area % or less (including 0 area %), and may even more preferably include polygonal ferrite of 65 area % or higher (including 100 area %) and bainite of 35 area % or less (including 0 area %), as a microstructure in a region up to a t/10 position in a subsurface (t is a thickness of the steel material).

As described above, generally, as an overall structure is not sufficiently transformed during manufacturing an ultra-thick high strength steel material, the structure may become coarse, and a difference in cooling speed may occur between a surface portion and a central portion due to an increased thickness during a rapid cooling process for securing strength. Accordingly, a large amount of low temperature transformation phase such as bainite, and the like, may be formed on a surface portion, which may cause difficulty in securing toughness.

However, in the present disclosure, by appropriately controlling conditions of finish-rolling and water-cooling in terms of manufacturing process, 50 area % or higher of polygonal ferrite may be secured in a surface portion, and accordingly, surface portion NRL-DWT properties may significantly improve.

According to an example embodiment, an ultra-thick high strength steel material may include bainite of 50 area % or less (including 0 area %) in a region from a t/10 position to a t/5 position in a subsurface area. When a fraction of bainite is controlled to be 50 area % or less in a region from a t/10 position to a t/5 position in a subsurface area, surface portion NRL-DWT properties may further improve. According to an example embodiment, two or more of acicular ferrite, quasi polygonal ferrite, polygonal ferrite, pearlite, and a martensite-austenite constituent may further be included other than bainite.

According to an example embodiment, an ultra-thick high strength steel material of the present disclosure may include a complex structure of acicular ferrite and bainite of 90 area % or higher (including 100 area %), and polygonal ferrite of 10 area % or less (including 0 area %) as microstructures in a region from a t/5 position to a t/2 position in a subsurface area. When an area ratio of a complex structure of acicular ferrite and bainite is less than 90%, or an area ratio of polygonal ferrite exceeds 10%, yield and tensile strength may degrade.

The ultra-thick high strength steel material of the present disclosure may have an advantage of excellent surface portion NRL-DWT properties. According to an example embodiment, a nil-ductility transition (NDT) temperature based on a naval research laboratory drop-weight test (NRL-DWT) prescribed in ASTM 208-06, may be −60° C. or less in a sample obtained from a surface.

Also, the ultra-thick high strength steel material of the present disclosure may have excellent low temperature toughness. According to an example embodiment, an impact transition temperature of a surface portion may be −40° C. or less.

Also, the ultra-thick high strength steel material of the present disclosure may have excellent yield strength. According to an example embodiment, in the ultra-thick high strength steel material, a thickness of a sheet may be 50 to 100 mm, and yield strength of the sheet may be 390 MPa or higher.

The ultra-thick high strength steel material described above may be manufactured by various methods, and the manufacturing method is not particularly limited. As a preferable example, the ultra-thick high strength steel material may be manufactured by the method as below.

In the description below, a method of manufacturing an ultra-thick steel material having excellent surface portion NRL-DWT properties, another aspect of the present disclosure, will be described in detail. In the description of the manufacturing method below, a temperature of a hot-rolled steel sheet (slab) may refer to a temperature at a t/4 portion (t: a thickness of a steel sheet) in a sheet thickness direction from a surface of the hot-rolled steel sheet (slab) unless otherwise indicated. A reference position with respect to measurement of a cooling speed during a water-cooling process may also be determined as above.

A slab having the above-described composition system may be reheated.

According to an example, a slab reheating temperature may be 1000 to 1150° C., and may be 1050 to 1150° C. preferably. When the reheating temperature is less than 1000° C., solid solution of Ti and/or Nb carbonitride formed during casting may not be sufficiently performed. When a reheating temperature exceeds 1150° C., austenite may become coarse.

The reheated slab may be rough-rolled.

According to an example embodiment, a temperature of the rough-rolling may be 900 to 1150° C. When the rough-rolling is performed within the above-mentioned temperature range, a casting structure such as dendrite, and the like, formed during casting, may be destroyed, and also the effect of decreasing a grain size may be obtained through recrystallization of coarse austenite.

According to an example embodiment, an accumulated reduction ratio during the rough-rolling may be 40% or higher. When an accumulated reduction ratio is controlled to be within the above-mentioned range, sufficient recrystallization may be caused such that a structure may be refined.

The rough-rolled slab may be finish-rolled, thereby obtaining a hot-rolled steel sheet.

It may be preferable to perform the finish-rolling under conditions of a temperature less than Ar3° C. on a slab surface during a final pass rolling and a temperature of Ar3° C. or higher and Ar3+50° C. or lower at a t/4 position from the slab surface. The conditions may be determined as above to facilitate the formation of polygonal ferrite on a surface portion of the hot-rolled steel sheet. When the temperature of the slab surface is Ar3° C. or higher, or when the temperature at the t/4 position from the slab surface exceeds Ar3+50° C., a large amount of coarse low temperature transformation phase such as bainite, and the like, may be formed on the surface portion of the hot-rolled steel sheet such that there may be difficulty in securing toughness. When the temperature at the t/4 position from the slab surface is less than Ar3° C., polygonal ferrite may be formed at the t/4 position before the finish-rolling such that yield strength may degrade.

The hot-rolled steel sheet may be water-cooled.

It may be preferable to start the water-cooling when the temperature of a surface of the hot-rolled steel sheet reaches Ar3-50° C. or less, which is to facilitate the formation of polygonal ferrite on a surface portion of the hot-rolled steel sheet. When the water-cooling is started before the temperature of a surface of the hot-rolled steel sheet reaches Ar3-50° C. or less, a large amount of coarse low temperature transformation phase such as bainite, and the like, may be created on the surface portion of the hot-rolled steel sheet such that it may be difficult to secure toughness.

According to an example embodiment, a cooling speed during the water-cooling may be 3° C./sec or higher. When the cooling speed is less than 3° C./sec, a central portion microstructure may not be properly formed, which may degrade yield strength.

According to an example embodiment, a cooling terminating temperature in the water-cooling may be 600° C. or less. When the cooling terminating temperature exceeds 600° C., a central portion microstructure may not be properly formed, which may degrade yield strength.

MODE FOR INVENTION

In the description below, an example embodiment of the present disclosure will be described in greater detail. It should be noted that the exemplary embodiments are provided to describe the present disclosure in greater detail, and to not limit the scope of rights of the present disclosure. The scope of rights of the present disclosure may be determined on the basis of the subject matters recited in the claims and the matters reasonably inferred from the subject matters.

Embodiment

A steel slab having a thickness of 400 mm and having a composition as in Table 1 was reheated at 1015° C., and then was rough-rolled at 1015° C., thereby manufacturing a bar. An accumulated reduction ratio during the rough-rolling was 50% in all samples, and a thickness of the rough-rolled bar was 200 mm in all samples. After the rough-rolling, the rough-rolled bar was finish-rolled under conditions as in Table 2, thereby obtaining a hot-rolled steel sheet. The hot-rolled steel sheet was water-cooled to 300 to 500° C. at a cooling speed indicated in Table 2, thereby manufacturing an ultra-thick steel material.

Thereafter, a microstructure of the manufactured ultra-thick steel material was analyzed, tensile properties was examined, and the results were listed in Table 3.

TABLE 1

| Steel Type | Alloy Composition (weight %) C | Mn | Ni | Cu | Ti | Nb | P (ppm) | S (ppm) |
|---|---|---|---|---|---|---|---|---|
| Inventive Steel 1 | 0.089 | 1.36 | 0.62 | 0.29 | 0.018 | 0.019 | 81 | 9 |
| Inventive Steel 2 | 0.066 | 1.65 | 0.27 | 0.15 | 0.021 | 0.021 | 46 | 28 |
| Inventive Steel 3 | 0.043 | 1.93 | 0.52 | 0.21 | 0.013 | 0.018 | 49 | 12 |
| Inventive Steel 4 | 0.075 | 1.53 | 0.51 | 0.22 | 0.019 | 0.023 | 78 | 13 |
| Inventive Steel 5 | 0.066 | 1.82 | 0.34 | 0.17 | 0.017 | 0.028 | 59 | 11 |

TABLE 1-continued

| Steel Type | Alloy Composition (weight %) C | Mn | Ni | Cu | Ti | Nb | P (ppm) | S (ppm) |
|---|---|---|---|---|---|---|---|---|
| Comparative Steel 1 | 0.13 | 2.01 | 0.42 | 0.31 | 0.023 | 0.019 | 65 | 19 |
| Comparative Steel 2 | 0.065 | 2.12 | 0.55 | 0.19 | 0.012 | 0.012 | 78 | 17 |
| Comparative Steel 3 | 0.031 | 1.15 | 0.45 | 0.18 | 0.016 | 0.018 | 51 | 23 |
| Comparative Steel 4 | 0.082 | 1.93 | 1.17 | 0.38 | 0.021 | 0.015 | 48 | 16 |
| Comparative Steel 5 | 0.079 | 1.68 | 0.32 | 0.22 | 0.044 | 0.048 | 57 | 13 |

TABLE 2

| Steel Type | Hot-rolled Steel Sheet Thickness (mm) | Surface Temperature During Final Pass Rolling (° C.) | Temperature at t/4 Position During Final Pass Rolling (° C.) | Surface Temperature When Cooling Starts (° C.) | Cooling Speed (° C./sec) | Note |
|---|---|---|---|---|---|---|
| Inventive Steel 1 | 95 | Ar3 − 31 | Ar3 + 15 | Ar3 − 81 | 3.8 | Embodiment 1 |
| | 95 | Ar3 − 68 | Ar3 − 23 | Ar3 − 117 | 3.9 | Comparative Example 1 |
| Inventive Steel 2 | 80 | Ar3 − 17 | Ar3 + 23 | Ar3 − 79 | 4.8 | Embodiment 2 |
| | 80 | Ar3 + 48 | Ar3 + 78 | Ar3 − 3 | 4.9 | Comparative Example 2 |
| Inventive Steel 3 | 95 | Ar3 − 27 | Ar3 + 7 | Ar3 − 81 | 3.9 | Embodiment 3 |
| | 95 | Ar3 + 69 | Ar3 + 95 | Ar3 + 3 | 3.8 | Comparative Example 3 |
| Inventive Steel 4 | 100 | Ar3 − 8 | Ar3 + 36 | Ar3 − 62 | 3.5 | Embodiment 4 |
| | 100 | Ar3 − 71 | Ar3 − 35 | Ar3 − 113 | 3.6 | Comparative Example 4 |
| Inventive Steel 5 | 80 | Ar3 − 18 | Ar3 + 12 | Ar3 − 71 | 5.0 | Embodiment 5 |
| Comparative Steel 1 | 80 | Ar3 − 21 | Ar3 + 14 | Ar3 − 86 | 4.7 | Comparative Example 5 |
| Comparative Steel 2 | 85 | Ar3 − 9 | Ar3 + 32 | Ar3 − 62 | 4.5 | Comparative Example 6 |
| Comparative Steel 3 | 90 | Ar3 − 10 | Ar3 + 27 | Ar3 − 61 | 4.3 | Comparative Example 7 |
| Comparative Steel 4 | 90 | Ar3 − 12 | Ar3 + 19 | Ar3 − 64 | 4.2 | Comparative Example 8 |
| Comparative Steel 5 | 95 | Ar3 − 5 | Ar3 + 44 | Ar3 − 56 | 3.9 | Comparative Example 9 |

TABLE 3

| Steel Type | Microstructure: Up to t/10 in Subsurface Area (area %) | B Fraction from t/10 to t/5 (area %) | AF and B Fractions from t/5 to t/2 (area %) | Tensile Properties: Yield Strength (MPa) | NDT Temperature (° C.) | Surface Portion Impact Transition Temperature (° C.) | Note |
|---|---|---|---|---|---|---|---|
| Inventive Steel 1 | 78PF + 32B | 18 | 91 | 403 | −75 | −57 | Embodiment 1 |
| | 89PF + 11B | 29 | 56 | 375 | −55 | −36 | Comparative Example 1 |
| Inventive Steel 2 | 68PF + 32B | 29 | 95 | 456 | −70 | −63 | Embodiment 2 |
| | 100B | 65 | 97 | 544 | −50 | −21 | Comparative Example 2 |

TABLE 3-continued

| Steel Type | Microstructure: Up to t/10 in Subsurface Area (area %) | Microstructure: B Fraction from t/10 to t/5 (area %) | Microstructure: AF and B Fractions from t/5 to t/2 (area %) | Tensile Properties: Yield Strength (MPa) | Tensile Properties: NDT Temperature (° C.) | Tensile Properties: Surface Portion Impact Transition Temperature (° C.) | Note |
|---|---|---|---|---|---|---|---|
| Inventive Steel 3 | 72PF + 28B | 41 | 96 | 468 | −65 | −61 | Embodiment 3 |
| | 100B | 59 | 98 | 559 | −55 | −18 | Comparative Example 3 |
| Inventive Steel 4 | 67PF + 33B | 38 | 97 | 448 | −70 | −59 | Embodiment 4 |
| | 91PF + 9B | 33 | 77 | 381 | −50 | −31 | Comparative Example 4 |
| Inventive Steel 5 | 72PF + 28B | 29 | 96 | 487 | −75 | −73 | Embodiment 5 |
| Comparative Steel 1 | 68PF + 32B | 72 | 98 | 556 | −45 | −72 | Comparative Example 5 |
| Comparative Steel 2 | 72PF + 38B | 63 | 97 | 521 | −50 | −49 | Comparative Example 6 |
| Comparative Steel 3 | 81PF + 19P | 15 | 52 | 312 | −70 | −64 | Comparative Example 7 |
| Comparative Steel 4 | 71PF + 29B | 52 | 97 | 549 | −55 | −59 | Comparative Example 8 |
| Comparative Steel 5 | 54PF + 46B | 47 | 96 | 519 | −50 | −29 | Comparative Example 9 |

In the microstructure, PF refers to polygonal ferrite, AF refers to acicular ferrite, B refers to bainite, and P refers to pearlite.

In all steel types, residual structures other than B were PF and AF in a region from t/10 to t/5, and a residual structure other than AF and B in a region from t/5 to t/2 was PF.

As indicated in Table 3, as for embodiments 1 to 5 which satisfied overall conditions suggested in the present disclosure, yield strength was 390 MPa or higher, a surface portion impact transition temperature was −40° C. or less, and a nil-ductility transition temperature (NDTT) value obtained in the NRL-DWT test based on a ASTM E208 standard was −60° C. or less.

As for comparative examples 1 to 4, as the temperature at the t/4 position during the final pass rolling in the finish-rolling was less than Ar3° C., a large amount of air-cooled ferrite was formed in a surface portion and up to the ¼t portion before and in the middle of the rolling process. Accordingly, yield strength was 390 MPa or less. Also, a two-phase rolling was performed due to a low rolling temperature, and strength of a surface portion increased because of a large amount of ferrite in the surface portion such that a surface portion impact transition temperature exceeded −40° C., and an NDTT exceeded −60° C.

Also, in comparative examples 2 and 3, as the temperature at the t/4 position during the final pass rolling in the finish-rolling exceeds Ar3+50° C., air-cooled ferrite was not formed before water-cooling such that a microstructure in a region up to the t/10 in a subsurface area was formed of a single phase structure of bainite. Also, as a microstructure in a region from a t/10 position to a t/5 position in a subsurface area had bainite of 50% or higher, a surface portion impact transition temperature exceeded −40° C., and an NDT temperature exceeded −60° C.

As for comparative example 5, a value of a content of C was higher than an upper limit content of C suggested in the present disclosure. Accordingly, a large amount of bainite single phase structure was formed in a region from a t/10 position to a t/5 position in a subsurface area due to excessive hardenability, and accordingly, an NDTT exceeded −60° C.

As for comparative example 6, a value of content of Mn was higher than an upper limit content of Mn suggested in the present disclosure. Accordingly, a large amount of bainite single phase structure was formed in a region from a t/10 position to a t/5 position in a subsurface area due to excessive hardenability, and accordingly, an NDTT exceeded −60° C.

As for comparative example 7, values of contents of C and Mn were lower than lower limit contents of C and Mn suggested in the present disclosure. Accordingly, hardenability was insufficient such that a large amount of polygonal ferrite and pearlite structures were generated, and accordingly, yield strength was 300 MPa or less.

As for comparative example 8, as a value of a content of Ni was higher than an upper limit content of Ni suggested in the present disclosure. Accordingly, a large amount of bainite single phase structure was formed in a region from a t/10 position to a t/5 position in a subsurface area due to excessive hardenability, and accordingly, an NDTT exceeded −60° C.

As for comparative example 9, value of contents of Ti and Nb were higher than upper limit contents of Ti and Nb suggested in the present disclosure. Accordingly, strength increased due to excessive hardenability, and a central portion impact transition temperature exceeded −40° C. due to degradation of toughness caused by strengthened precipitation, and an NDTT exceeded −60° C.

While exemplary embodiments have been shown and described above, the scope of the present disclosure is not limited thereto, and it will be apparent to those skilled in the art that modifications and variations could be made without departing from the scope of the present invention as defined by the appended claims.

The invention claimed is:

1. An ultra-thick steel material, comprising:

a composition consisting of: by weight %, 0.04 to 0.09% of C, 1.2 to 2.0% of Mn, 0.2 to 0.9% of Ni, 0.005 to 0.04% of Nb, 0.005 to 0.03% of Ti, 0.1 to 0.4% of Cu, 100 ppm or less of P, 40 ppm or less of S, and a balance of Fe and inevitable impurities, wherein the steel material comprises polygonal ferrite of 50 area % or higher, including 100 area %, and bainite of 50 area % or less, including 0 area %, as a microstructure in a region up to a t/10 position in a subsurface area, wherein the steel material comprises acicular ferrite and bainite of 90 area % or higher, including 100 area %, and polygonal ferrite of 10 area % or less, including 0 area %, in a region from a t/5 position to a t/2 position in a subsurface area, where t is a thickness of the steel material, wherein the steel material is in the form of a steel sheet having a thickness of 50 to 100 mm.

2. The ultra-thick steel material of claim 1, further comprising: bainite of 50 area % or less, including 0 area %, in a region from a t/10 position to a t/5 position in a subsurface area.

3. The ultra-thick steel material of claim 1, wherein a nil-ductility transition temperature, an NDT temperature, according to a naval research laboratory drop-weight test, a NRL-DWT, prescribed in ASTM 208-06, is −60° C. or less in a sample obtained from a surface.

4. The ultra-thick steel material of claim 1, wherein an impact transition temperature is −40° C. or less in a sample obtained from a t/4 position in a subsurface area.

5. The ultra-thick steel material of claim 1, wherein the steel sheet has a yield strength is 390 MPa or higher.

6. An ultra-thick steel material, comprising:

by weight %, 0.04 to 0.09% of C, 1.2 to 2.0% of Mn, 0.2 to 0.9% of Ni, 0.005 to 0.04% of Nb, 0.005 to 0.03% of Ti, 0.1 to 0.4% of Cu, 100 ppm or less of P, 40 ppm or less of S, and a balance of Fe and inevitable impurities, wherein the steel material comprises polygonal ferrite of 50 area % or higher, including 100 area %, and bainite of 50 area % or less, including 0 area %, as a microstructure in a region up to a t/10 position in a subsurface area, wherein the steel material comprises acicular ferrite and bainite of 90 area % or higher, including 100 area %, and polygonal ferrite of 10 area % or less, including 0 area %, in a region from a t/5 position to a t/2 position in a subsurface area, where t is a thickness of the steel material, and bainite of 50 area % or less, including 0 area %, in a region from a t/10 position to a t/5 position in a subsurface area, wherein the steel material is in the form of a steel sheet having a thickness of 50 to 100 mm, and wherein a nil-ductility transition temperature, an NDT temperature, according to a naval research laboratory drop-weight test, a NRL-DWT, prescribed in ASTM 208-06, is −60° C. or less in a sample obtained from a surface.

* * * * *